United States Patent [19]

Fattler

[11] 4,289,487

[45] Sep. 15, 1981

[54] SWIMMING DEVICE

[76] Inventor: Karl W. Fattler, 33-06 31st Ave., Long Island City, N.Y. 11106

[21] Appl. No.: 77,048

[22] Filed: Sep. 19, 1979

[51] Int. Cl.[3] ..... A63B 35/10

[52] U.S. Cl. ..... 440/31; 74/351

[58] Field of Search ..... 440/26, 27, 28, 21, 440/31, 32; 74/351; 9/301; 114/315

[56] References Cited

U.S. PATENT DOCUMENTS

| | | | |
|---|---|---|---|
| 732,405 | 6/1903 | Gallagher | 440/31 |
| 955,279 | 4/1910 | Moore, Sr. | 74/351 |
| 1,879,180 | 9/1932 | Gendreau et al. | 440/31 |
| 2,561,960 | 7/1951 | Weaver | 74/351 X |
| 2,684,599 | 7/1954 | Fischer | 74/351 |

FOREIGN PATENT DOCUMENTS

| | | | |
|---|---|---|---|
| 687869 | 5/1930 | France | 114/315 |
| 974856 | 10/1950 | France | 9/301 |

*Primary Examiner*—George E. A. Halvosa
*Attorney, Agent, or Firm*—Richard L. Miller

[57] ABSTRACT

A mechanical apparatus for moving a swimmer ahead in the water, including a frame secured behind the swimmer by shoulder straps and a waist belt, a pair of bicycle type foot operated pedals rotating a propeller and a hand-cranked winch on the belt buckle controlling a change speed mechanism for faster or slower travel.

3 Claims, 4 Drawing Figures

10
17
19
16
15
14
13
18
12
11
4
4
30
31
3
3
26
25
27
27
21
22
20

17
11
14
27
39
40
41
28
28
21
20

41
42
29
36
24
43
44
23

32
30
33
35
34
24
23
38
37

SWIMMING DEVICE

BACKGROUND OF THE INVENTION

This invention relates generally to swimming machines. It is well known that in the past various type of swimming aids have been developed for allowing a swimmer to travel in the water by means of helping the arms in stroking the water, however none of them have become popular in use due to various inefficiencies in their designs and operation.

SUMMARY OF THE INVENTION

Accordingly it is a principal object of the present invention to provide a swimming device that is designed in a practical manner by being foot-pedal operated so as to rotate a propeller that moves the swimmer ahead in the water in an easier manner than by stroking the water with the arms at all.

Another object is to provide a swimming device which accordingly allows the hands and arms free for steering or other uses.

Still another object is to provide a swimming device having a novel variable speed control.

Still a further object is to provide a swimming device which is small and light in weight so that it can be conveniently carried by a swimmer to the water, which utilizes no fuels, and which promotes a healthful exercise in foot pedaling.

Further objects of the invention will appear as the description proceeds.

To the accomplishment of the above and related objects, this invention may be embodied in the form illustrated in the accompanying drawings, attention being called to the fact, however that the drawings are illustrative only, and that changes may be made in the specific construction illustrated and described within the scope of the appended claims.

BRIEF DESCRIPTION OF THE DRAWING FIGURES

DETAILED DESCRIPTION OF PREFERRED EMBODIMENT

Figure 1:
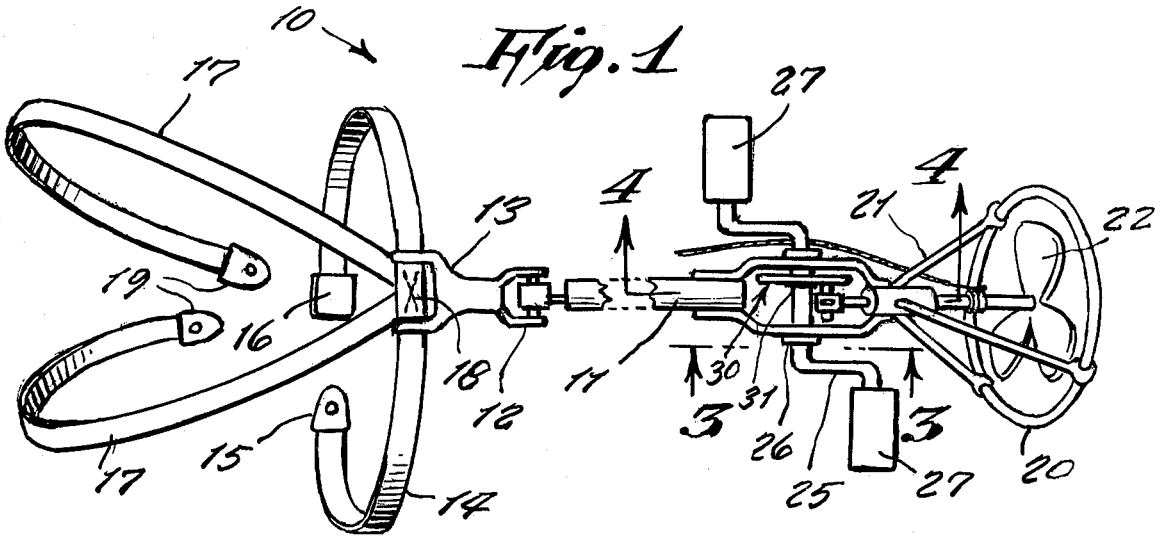
FIG. 1 is a top view of the invention shown in a horizontal position.
Figure 2:
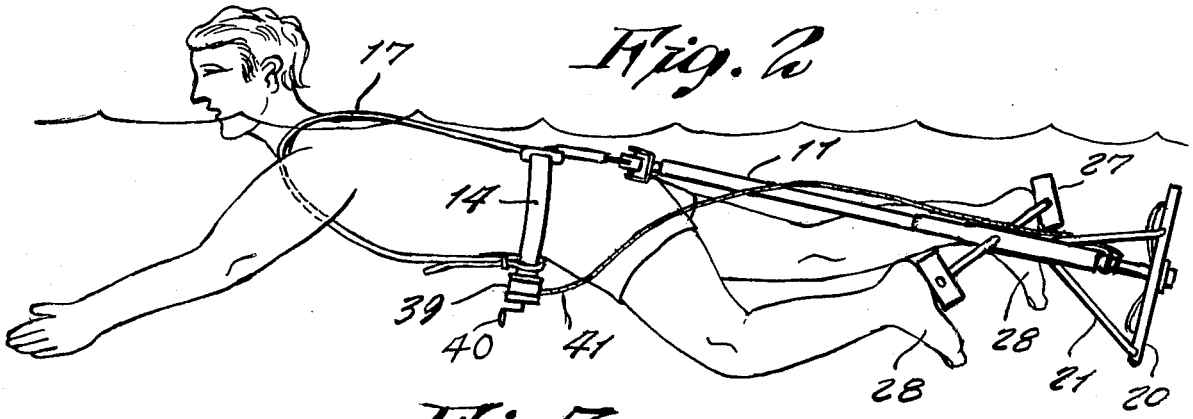
FIG. 2 is a side view thereof shown worn by a swimmer travelling horizontally in the water.
Figure 3:
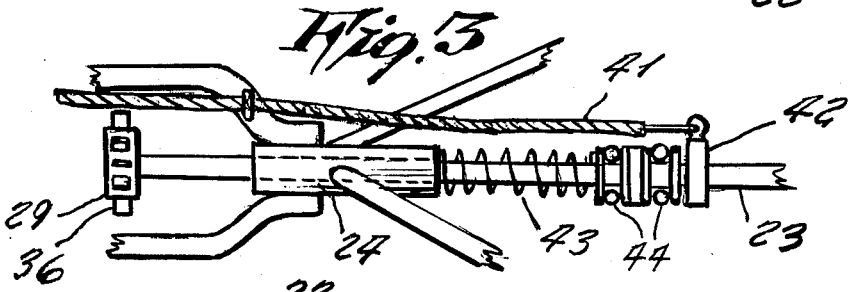
FIG. 3 is an enlarged detail view in direction 3—3 of FIG. 1, and illustrating a detail of a change speed mechanism thereof.
Figure 4:
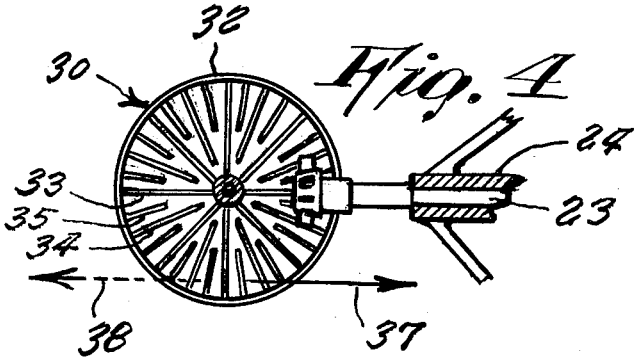
FIG. 4 is an enlarged detail view in direction 4—4 of FIG. 1, and illustrating a further detail of the change speed mechanism.

Referring now to the drawing in greater detail, the reference numeral 10 represents a swimming device, according to the present invention, wherein there is a lightweight frame 11 which at a forward end is connected by means of a universal joint 12 to a metal loop 13 through which a waist belt 14 is threaded. Opposite ends of the belt include a metal prong 15 that snap fits into a buckle 16 for locking the belt around a swimmer's waist. A pair of shoulder straps 17 are stitched at 18 to the belt, so as to extend across the swimmer's shoulders and the free ends thereof, fitted with metal prongs 19 snap fit into the buckle 16 which is designed to receive three prongs.

A rear, opposite end of the frame 11 has a rigid metal ring 20 secured by braces 21 so as to protectively surround a three-bladed propeller 22 fixed to a shaft 23 rotatable in frame bearing sleeve 24.

Along an intermediate portion of the frame, a foot pedal crank shaft 25 extends transversely through the frame and is supported rotatably free in frame bearings 26. A foot pedal 27 is on each opposite end of the crank shaft, for being pushed by a swimmer's feet 28, in order to rotate the propeller by foot power.

In the present invention, a small gear 29 is affixed on a forward end of the propeller shaft 23 and engages a gear 30 affixed on the transverse crankshaft. The gear 30 is comprised of a hub 31 and outer rim 32 between which eight equally spaced apart, radial spokes 33 extend. Midway between spokes 33 is a long spoke 34 affixed to the rim but not reaching the hub. Midway between each spoke 33 and a long spoke 34, there is a short spoke 35, likewise affixed to the rim. This design eliminates the space between the spokes becoming excessively narrowed in the vicinity of the hub, so that teeth 36 of gear 29 readily find an approximately same space between the spokes 33, 34 and 35 whether engaging the gear 30 near a rim or near the hub. The above described spokes may be made of ridged plastic and flex slightly so to accommodate the teeth 36 which comprise radially extending flat blades, as shown.

It is now evident that by sliding the shaft 23 in the bearing 24, and gear 29 and propeller 22 therewith, into the direction of arrow 37 (and toward the rim) the propeller rotates faster. If slided in direction of arrow 38 (and toward the hub) the propeller then rotates slower. The sliding of shaft 23 is accomplished by a winch 39 on the belt buckle 16 being rotated by a hand operated crank 40 so as to wind a flexible cable 41 thereabout attached to collar 42 placed rotatably free around the shaft 23 and which when pulled against the action of compression coil spring 43, moves the gear 29 into direction of arrow 38. The winch is constructed and arranged such that it maintains the shaft, gear 29 and propeller in a selected position without further restraint by the operator thereby allowing free use of the hands and arms for steering. When the cable is released, the spring pushes the gear 29 in the direction of arrow 37. Thrust bearings 44 are between the collar and spring, as shown, for smoother operation.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A swimming device, comprising in combination, a frame supported at its forward end on a waist belt, shoulder straps extending from the waist belt, a crankshaft rotatably positioned transverse to the frame, foot pedals located at opposing ends of the crankshaft, a first gear fixed onto said crankshaft and having a plurality of radially different speed controlling sections thereon, with the slower speed control section being radially inward of the faster control section, a propeller shaft extending from the rear end of said frame, a propeller fixed at the distal end to said propeller shaft, a second gear fixed at the medial end of said propeller shaft and engaging said first gear, a housing supported by said frame for protectively surrounding said propeller, biasing means for normally biasing said second gear to engage said first gear at the outermost speed control section thereof, said shaft, second gear and propeller being slidable together relative to said frame and housing in the direction of the shaft's axis, a collar formed on said propeller shaft, a hand operated rotatable winch formed on said waist belt, a cable extending from said winch and coupled to said collar, whereby the operator of said winch selectively moves the second gear against the bias to engage slower speed control sections of the first gear by winding said cable about said winch, said winch being constructed and arranged to maintain said second gear in a selected position without further restraint by the operator.

2. The combination as in claim 1, wherein said first gear comprises a wheel having a hub and an outer rim, a plurality of sets of spokes extending from the outer rim toward the hub, the length of the spokes comprising a set being uniform but varying in length from the spokes in the other sets, all the spokes being uniformly spaced apart in a circumferential direction, and wherein said second gear is arranged at right angles to said first gear and comprises a wheel having a plurality of equally spaced apart flat blades radially extending from a periphery thereby.

3. The combination as in claim 2, wherein said spokes are formed of ridged plastic, which can flex to accommodate the flat blades of said second gear.

* * * * *